US005125166A

United States Patent [19]

Farmer

[11] Patent Number: 5,125,166

[45] **Date of Patent: * Jun. 30, 1992**

[54] SECTIONALIZED CENTRIFUGAL DRYING BASKET/SCREEN ASSEMBLY

[75] Inventor: Jerry D. Farmer, Galatia, Ill.

[73] Assignee: Process Equipment Company, Galatia, Ill.

[ * ] Notice: The portion of the term of this patent subsequent to May 8, 2007 has been disclaimed.

[21] Appl. No.: 503,509

[22] Filed: Dec. 1, 1989

Related U.S. Application Data

[63] Continuation of Ser. No. 163,804, Mar. 3, 1988, Pat. No. 4,922,625.

[51] Int. Cl.[5] ..... F26B 17/24

[52] U.S. Cl. ..... 34/58; 34/184

[58] Field of Search ..... 34/58, 184; 210/380.1, 210/499; 209/303

[56] References Cited

U.S. PATENT DOCUMENTS 4,236,322 12/1980 Hastings ..... 34/58

4,922,625 5/1990 Farmer ..... 34/58

*Primary Examiner*—Henry A. Bennett

*Attorney, Agent, or Firm*—Hoffman, Wasson & Gitler

[57] ABSTRACT

A sectionalized screen/basket assembly for a centrifugal dryer for coal slurry comprises a screen formed in an upper section and a lower section, enabling one to save substantially on screen replacement costs, in as much as the great preponderance of screen wear in such dryers is at the top of the screen, at the point of slurry introduction. An internal circumferential ridge on the upper screen creates a particle cake that further reduces wear.

2 Claims, 2 Drawing Sheets

SECTIONALIZED CENTRIFUGAL DRYING BASKET/SCREEN ASSEMBLY

CONTINUING DATA

This application is a continuation of Ser. No. 07/163,804, filed Mar. 3, 1988, which is now U.S. Pat. No. 4,922,625.

BACKGROUND OF THE INVENTION

This invention relates to a drying screen and basket for a centrifugal dryer used to remove water and fines from an aqueous slurry of pulverized coal.

Pulverized coal slurry centrifugal driers may include a frustoconical screen, supported by a basket of similar geometry, both supported for rotation about a vertical axis, and downwardly divergent. The screen/basket assembly is rapidly rotated (e.g., at 600–900 rpm), and slurry is introduced into the top end of the assembly. The slurry strikes the screen at its top interior, and tends to move downward to the larger diameter portion of the screen as the slurry is centrifuged. Water and fines smaller than the screen openings escape through the screen, while larger particles are harvested by a more slowly rotating (e.g., 75 rpm) tapered auger blade which plows these larger particles downward to an outfeed conveyor. The fines and water are directed to a separate trough, from which they are removed as waste. The clearance between the auger blade and the screen interior is on the order of 0.010–0.015 inches.

Drier screen, being of fine mesh, are susceptible to abrasive wear in service, and in fact, these screens must be replaced with great frequency. Any replacement is attended by considerable downtime, and not inconsiderable expense. Presently, the entire screen must be replaced when it is worn, despite the fact that the wear is almost exclusively confined to the point of the screen which bears the initial impact of the slurry, that is, the top few inches of the screen.

It is therefore an object of the invention to provide the industry with a drying basket having increased durability, yet having lower replacement cost. This object is achieved by providing a centrifugal drying basket/screen assembly formed in two sections: a lower major section, and a smaller upper section, so that only the upper section need be regularly replaced. The lower portion of the assembly can be replaced only as needed, on a much more infrequent basis.

A further object of the invention is to reduce the effect of slurry impact at the upper portion of a two-part screen/basket assembly, and thus prolong the life of even the upper portion. This objective is satisfied by creating a circumferential ridge on the interior surface of the drying screen, just below the point of initial slurry impact. The ridge acts as a dam, preventing particles from passing downward along the screen at that point, so that a cake of particles are built up inside the screen at that point. This cake then receives direct impact from entering particles, thus protecting the underlying screen.

A further object of the invention is to provide a centrifugal coal dryer with a basket/screen assembly having integral fins to create a vacuum to assist in removing water from the slurry.

Another object of the invention is to provide a two-part basket/screen assembly that is easily disassembled and rebuilt. Other objects of the invention will be apparent from the following description.

SUMMARY OF THE INVENTION

The invention is summarized as a two-part centrifugal drying screen/basket assembly for a coal slurry, wherein the screen is provided in two sections, the upper section being readily replaceable for more frequent replacement than the lower section.

In one variation, the interior of the upper screen may have a circumferential ridge created around its interior to establish an impact-absorbing layer of particles at the point of slurry introduction.

In another variation, the upper and lower basket sections may have air vanes affixed to the exterior thereof to create a vacuum at the exterior of the drying screen.

BRIEF DESCRIPTION OF THE DRAWINGS

In the accompanying drawings.

Figure 1:
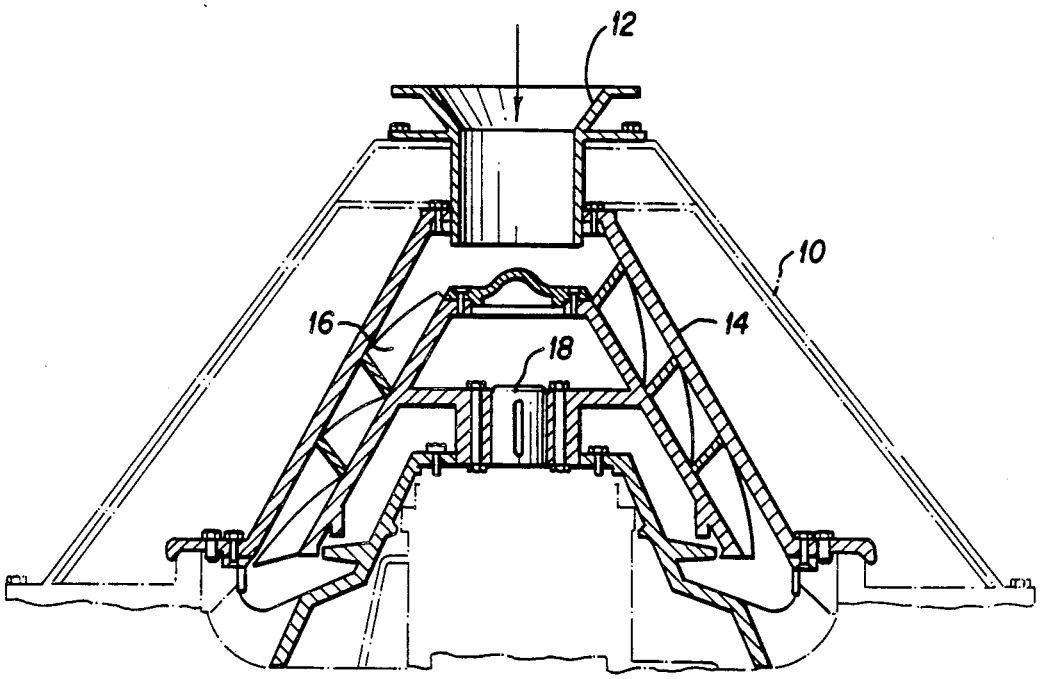
PRIOR ART FIG. 1
FIG. 1 shows a prior are one-piece drying basket, in a conventional environment.

A conventional centrifugal dryer for coal slurry is shown in FIG. 1. The dryer comprises a rotary housing 10, shown in phantom, which supports along a vertical axis of rotation an inlet funnel 12. A frustoconical screen 14, and a matching frustoconical auger blade 16 are rotably supported within the housing. The blade, which clears the screen by only about 0.010–0.015 inch, is supported on a shaft 18 that rotates more slowly than does the screen, so as to scrape or plow coal particles from the screen to an outfeed conveyor, not shown. In the conventional structure, the screen is unitary, so that the entire screen must be replaced once the upper end of the screen is breached or otherwise damaged by the abrasive effect of incoming slurry.

DESCRIPTION OF THE PREFERRED EMBODIMENT

Figure 3:
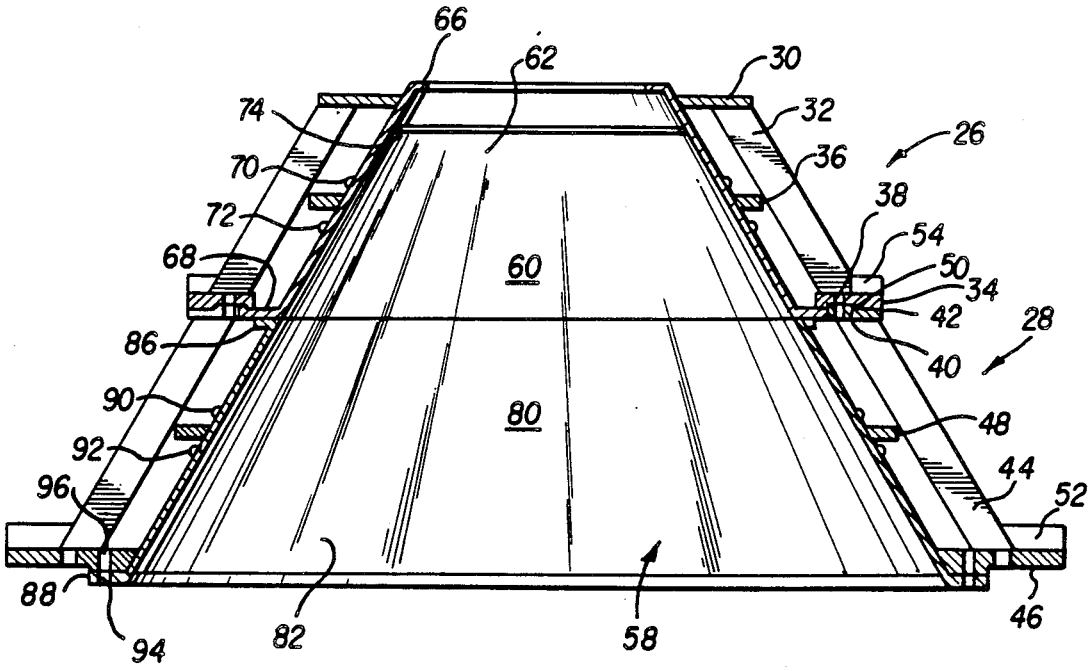
FIG. 3 is a sectional view of the invention, taken along the longitudinal plane III—III in FIG. 2.
Figure 2:
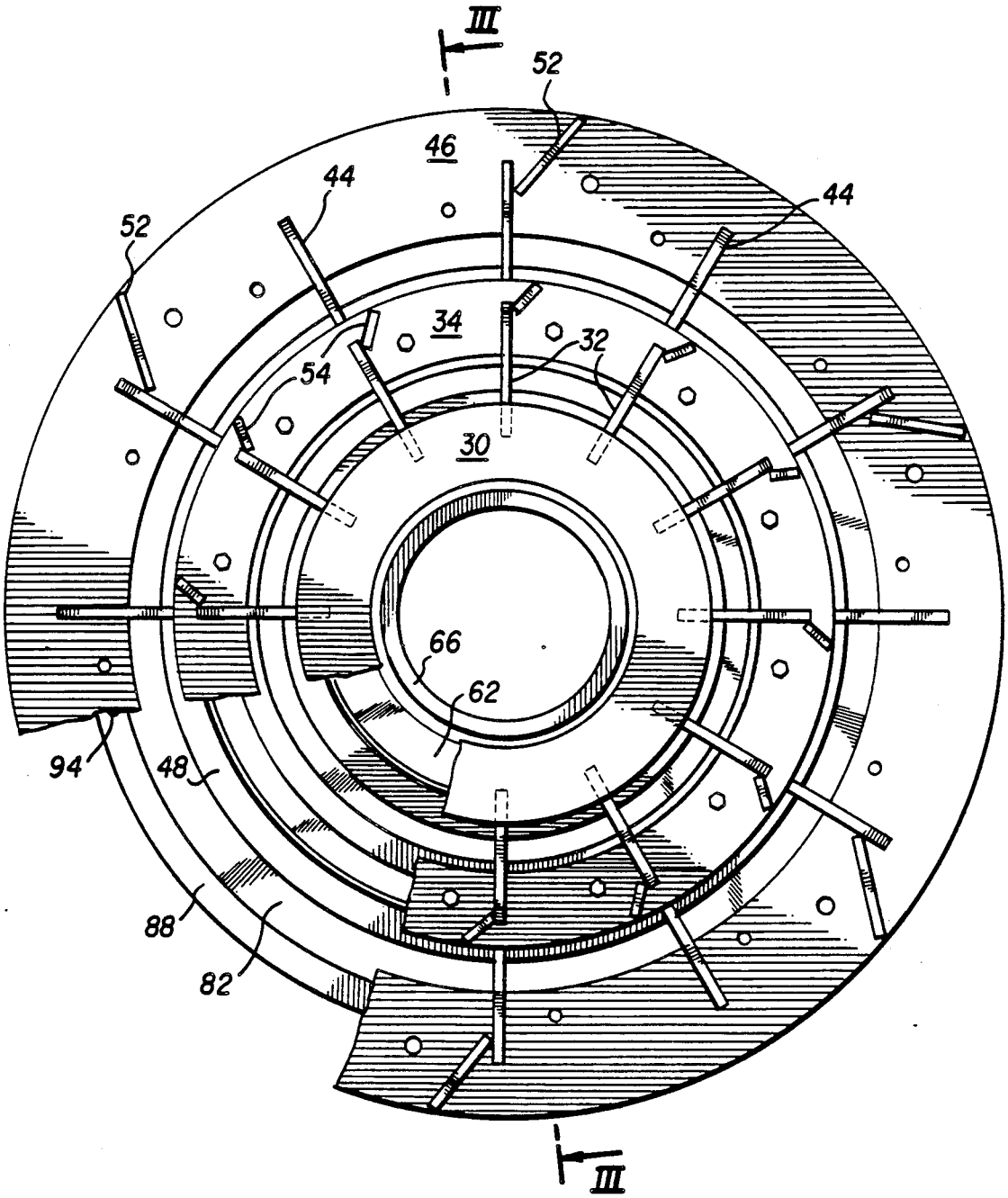
FIG. 2 is a top view of a two-part basket assembly embodying the invention, partially broken away to show the underlying screen.

FIGS. 2 and 3 show two views of a basket/screen assembly embodying the invention. This assembly is a bolt-in replacement for the conventional screen/basket assembly, so that no modification to the existing dryer structure is required. The overall dimensions are substantially those of the conventional structure.

As shown in FIGS. 2 and 3, the basket/screen assembly comprises a basket assembly 22 supporting therein a screen assembly 58. Both assemblies are frustoconical in shape, diverging downward in their installed orientation, about a common vertical axis of rotation.

The basket assembly 22 comprises an upper part 26 and a lower part 28. The upper part 26 includes a top flange 30 connected by a plurality of bars 32 to a bottom flange 34. Each of the bars extends substantially along a generatrix of the conical surface which defines the envelope of the basket. A support ring 36 is welded inside the bars 32 intermediate the top and bottom flanges, to support the screen. The bottom flange 34 has a plurality of circumferentially spaced bolt holes 38 extending therethrough, at the locus of a circumferential groove 40 formed in the bottom axial face of the bottom flange 34.

The lower basket part 28 is similar in construction to the upper section, having an upper flange 42 connected via a plurality of bars 44 to a lower flange 46. A second intermediate ring 48 is connected within the bars to support the screen, and the upper flange has an upwardly protruding circumferential ridge 50 in its top axial surface, configured to fit within the groove 40 to locate the upper basket part radially with respect to the lower basket part when the two are joined by bolts (not shown, for clarity).

A plurality of circumferentially spaced vanes 52 are connected by welding to the upper surface of the lower flange 46. The orientation of the vanes is seen in FIG. 3, looking down on the counter-clockwise rotating assembly. Each vane, formed of plate material, extends in a substantially vertical plane upward from the flange; the plane is angled at about 45° with respect to a radial plane. A similar set of vanes 54 is affixed to the bottom flange 34 of the upper basket part.

The screen assembly 58 of the invention, seen in FIG. 2, comprises an upper section 60 and a lower section 80. The upper section includes in major part a substantially frustoconical sieve 62 adapted to nest within the upper basket part. The sieve comprises a great plurality of circumferentially spaced parallel slots approximately 0.010 inch wide, each extending between an internal upper flange 66 and an external lower flange 68. To maintain slot width, two beads 70, 72 are welded around the outside of the sieve, straddling the support ring 36.

On the interior of the sieve 62 of the upper screen section 60, between the levels of the upper external bead 70 and the upper flange 66, a ridge 74 is formed by welding. I prefer for the ridge to be about one-eighth inch deep and three-sixteenths of an inch wide. The ridge 74 is placed just below the level at which coal slurry first impinges on the screen as it exits the funnel bottom.

The lower screen section 80 comprises similarly, a sieve 82 bounded by upper and lower external flanges 86 and 88 respectively, with external reinforcing beads 90, 92 welded around the screen. The lower flange 88 has a plurality of holes 94 alignable with holes 96 in the lower basket flange 46, to receive bolts (not shown). The screen/basket assembly is constructed as follows. The upper screen portion 60 is nested within the upper basket part 26, whereupon the top of the upper screen portion protrudes about three-quarters of an inch above the top flange 30 of the basket, and the lower flange of the upper screen section abuts the lower flange 34 of the upper basket part. The screen flange 68 is then clamped between the basket flanges 34 and 42 as the upper and lower baskets are bolted together. Finally, the lower screen section 80 is nested within the lower basket part 28, and is bolted to the bottom flange of the lower basket part. The basket/screen assembly is thereafter installed in the centrifugal dryer.

Operation is substantially as described above for prior art devices. The basket/screen assembly is rotated by application of torque to its lower flange 46 from another portion of the apparatus (not shown) at 600–900 rpm, in the counterclockwise direction as seen from above. Simultaneously, a conventional auger blade is rotated in the same direction within the basket at a much slower speed. Coal slurry is introduced via a funnel into the upper end of the upper screen section 60, where it impinges upon the sieve interior 62 at a point just above the internal ridge 74. As the ridge acts as a dam, a cake of coal particles quickly builds up on the screen at this point, and the cake takes the brunt of the particle impact thereafter. A marked prolongation of screen life is observed, owing to the provision of the ridge.

As the basket assembly rotates, its vanes 52, 54 create a partial vacuum around the exterior of the screen assembly, which assists centrifugal forces in removing water from the material.

The invention is subject to many variations around the sectionalized screen feature. For example, the basket could be made as one piece, or the screen could be provided with reinforcement and impact abrasion preventing means other than that described above.

Inasmuch as the invention is subject to many variations and modifications, the foregoing description, and the drawings, are intended to be only illustrative of the invention, whose scope is to be measured by the following claims.

I claim:

1. A screen assembly for a centrifugal coal slurry dryer of the type having a downwardly screen support structure having a vertical axis of rotation, said screen assembly comprising a plurality of vertically separate screen sections, whereby only that section subject to wear may be replaced when necessary, said assembly having an uppermost section into which slurry is introduced wherein said screen assembly comprises a plurality of slots extending along generatrices of said screen from top to bottom.

2. The invention of claim 1, further comprising an internal circumferential ridge protruding from the inner surface of said uppermost section in the vicinity of the point of initial impact of the slurry upon the screen, to create a particle cake on the screen to reduce impact damage thereto.

* * * * *